US005441149A

United States Patent [19]

Willard et al.

[11] Patent Number: 5,441,149

[45] Date of Patent: Aug. 15, 1995

[54] WRITING INSTRUMENT CONTAINER

[75] Inventors: Michael D. Willard, Olathe, Kans.; Charles W. Dietterich, Brodheadsville, Pa.; Richard A. Tarozzi, Gales Ferry, Conn.

[73] Assignee: Binney & Smith Inc., Easton, Pa.

[21] Appl. No.: 118,455

[22] Filed: Sep. 8, 1993

[51] Int. Cl.[6] ..... B65D 85/28

[52] U.S. Cl. ..... 206/214; 206/224; 206/457; D9/308; D19/82

[58] Field of Search ..... D9/308, 309, 341; D19/81, 82, 85; 206/45.19, 214, 224, 371, 443, 457, 805, 575, 372; 211/69.1, 69.5

[56] References Cited

U.S. PATENT DOCUMENTS

| | | | |
|---|---|---|---|
| D. 79,822 | 11/1929 | Larrabee | D19/82 |
| D. 88,371 | 11/1932 | Cuff | D21/129 |
| D. 149,184 | 4/1948 | Jolley | D9/308 |
| D. 160,161 | 9/1950 | Gass | D19/85 |
| D. 175,742 | 10/1955 | Ruiz et al. | D5/5 |
| 193,460 | 7/1877 | Reed | D21/129 X |
| D. 211,556 | 7/1968 | Sherman | D2/279 |
| D. 217,374 | 4/1970 | Hubiak | D21/129 X |
| D. 253,179 | 10/1979 | Bosler | D19/82 |
| 271,817 | 2/1883 | Dumke | 206/214 |
| D. 282,032 | 1/1986 | Lemmeyer | D6/440 |
| D. 287,112 | 12/1986 | Legueu | D12/84 |
| D. 309,643 | 7/1990 | Picozza et al. | D21/128 |
| D. 316,273 | 4/1991 | Tsuji | D19/75 |
| D. 337,517 | 7/1993 | Hwang | D21/129 X |
| 540,268 | 6/1895 | Newell . | |
| 632,167 | 8/1899 | Biesmeyer | 206/214 |
| 1,928,323 | 9/1933 | Sweitzer | 446/76 |
| 2,621,098 | 12/1952 | Ford et al. | 446/76 |
| 3,331,105 | 7/1967 | Gordon | 206/805 |
| 3,576,253 | 4/1971 | Keats | 206/45.14 |
| 4,136,773 | 1/1979 | Booth | 206/214 |
| 4,519,498 | 5/1985 | Booth | 206/214 |
| 4,574,946 | 3/1986 | Hanazato | 206/45.19 |
| 4,714,158 | 12/1987 | Oltman et al. | 206/372 |
| 4,736,838 | 4/1988 | Nakata | 206/214 |
| 4,753,346 | 6/1988 | Tsuji | 206/224 |
| 4,989,734 | 2/1991 | Mode et al. | 206/575 |
| 5,004,103 | 4/1991 | Connors et al. | 211/69 X |
| 5,163,549 | 11/1992 | Hayduchok | 206/224 |

OTHER PUBLICATIONS

Color photocopies of four photographs of NYLENT ® School Bus, Nylent Corporation, Rockford, Ill., U.S.A. no date.

Two photographs of Crayola ® Crayons crayon holder, Binney & Smith, Inc., Easton, Pa. ©1976.

Four photographs of Fun Years Electronic CHOO CHOO and packaging, Geoffrey, Inc., distributed by Toys "R" Us, Inc. Paramus, N.J., U.S.A. 1993.

*Primary Examiner*—Jimmy G. Foster

*Attorney, Agent, or Firm*—Leydig, Voit & Mayer, Ltd.

[57] ABSTRACT

A portable writing instrument container is disclosed for holding, transporting and storing writing instruments in the shape of a vehicle, such as a bus or locomotive. The container consists of a lower housing, an upper housing, a sharpener and a plurality of compartments for holding a plurality of writing instruments. The upper housing is removable to allow access to the compartments and the writing instruments. The container has functioning wheels to facilitate the playfulness of the container. In operation, the functioning wheels provide the ability to transport the container along a surface. In addition, a kit includes the writing instrument container and writing instruments which are packaged in an enclosure for shipment to the customer.

84 Claims, 7 Drawing Sheets

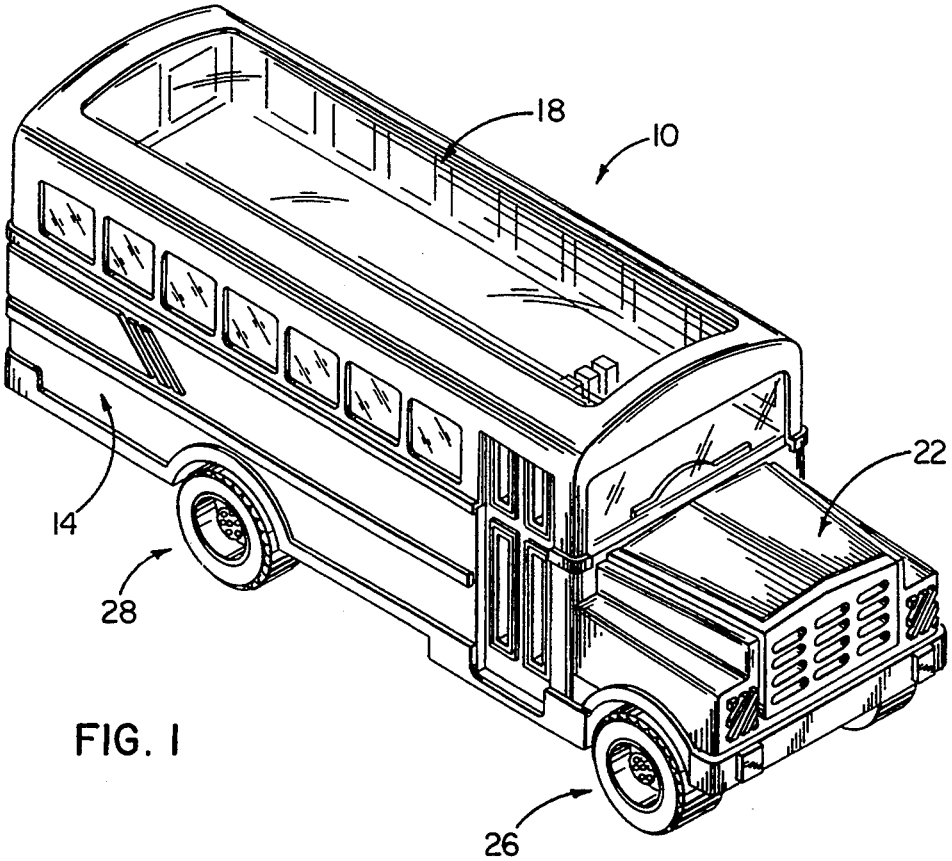
FIG. 1
FIG. 3
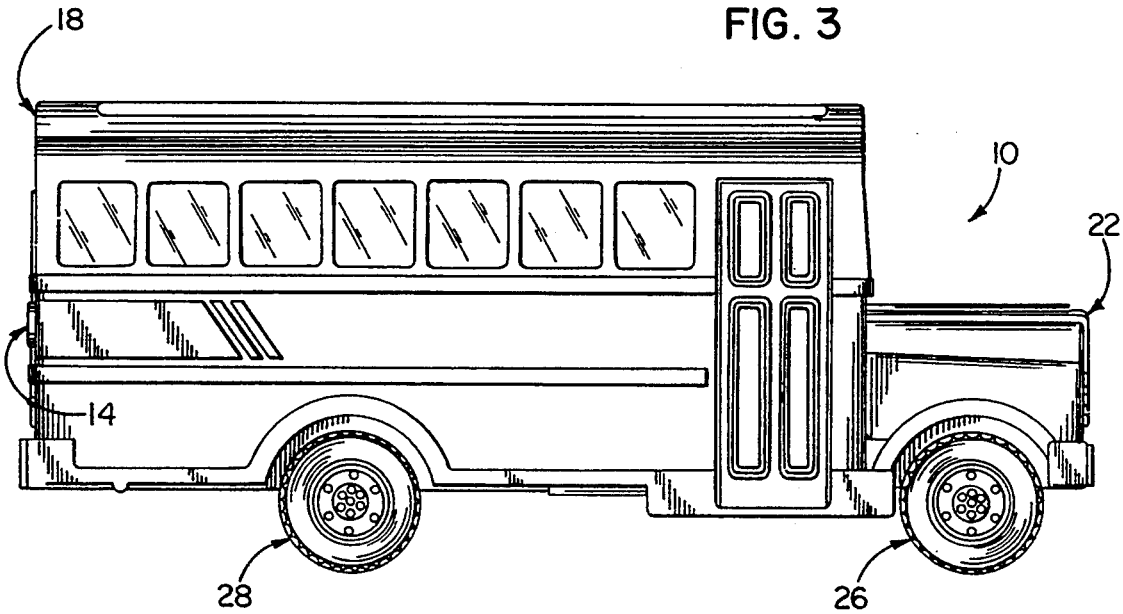

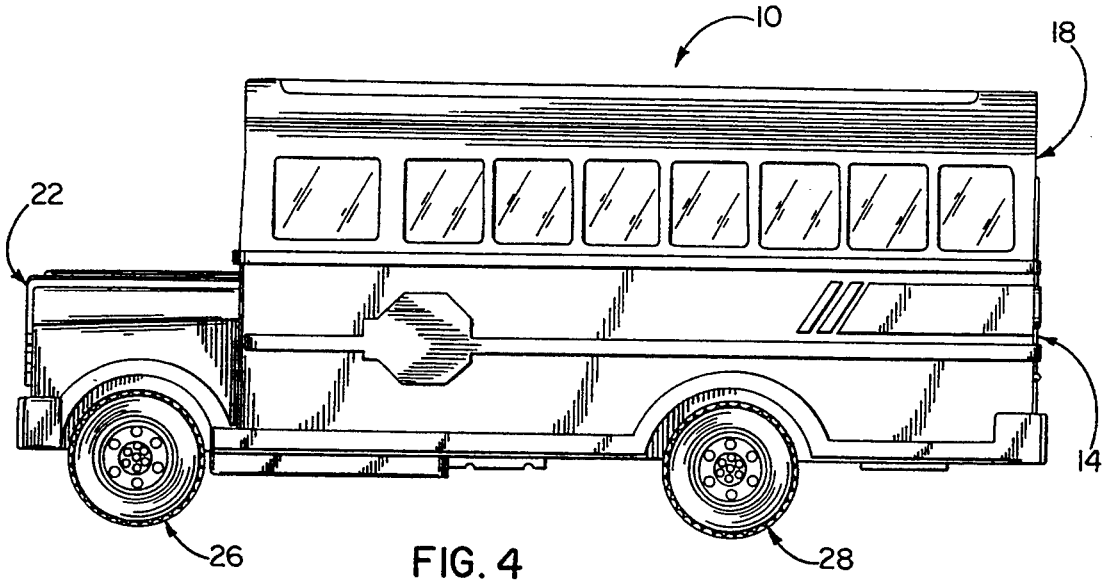
FIG. 4
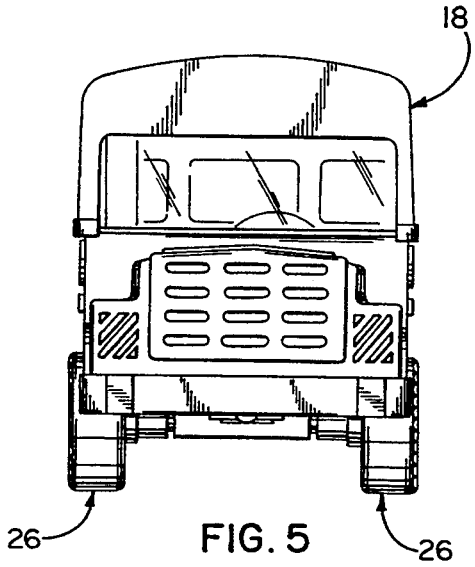
FIG. 5
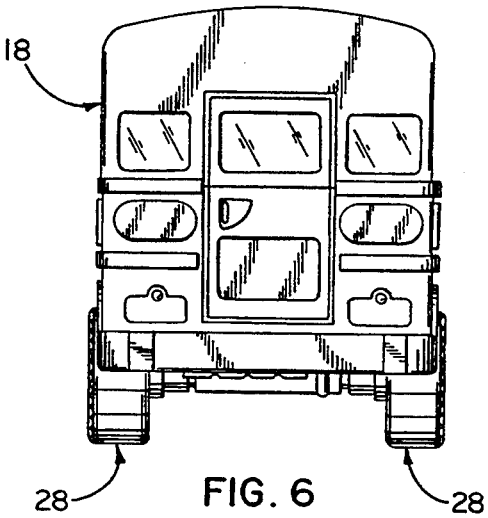
FIG. 6
FIG. 7
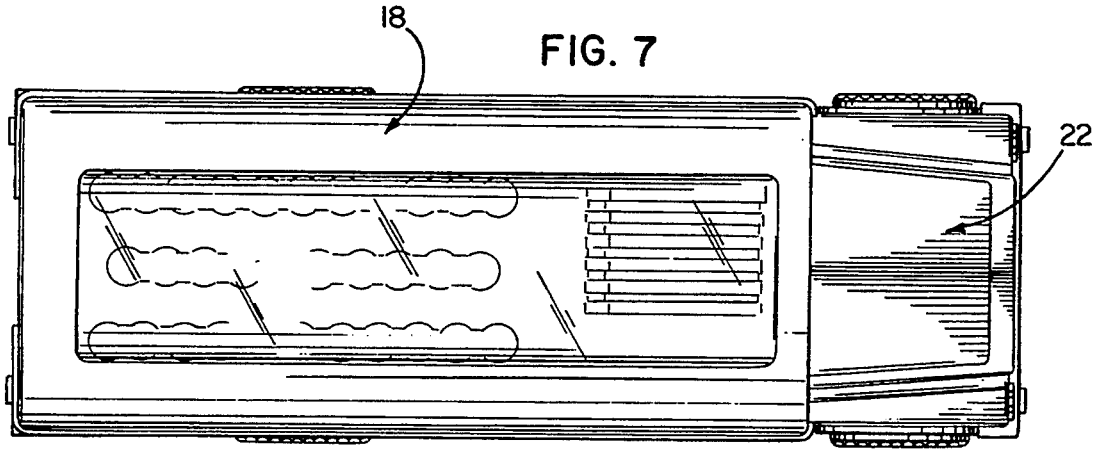

WRITING INSTRUMENT CONTAINER

FIELD OF THE INVENTION

The present invention relates to containers for holding, transporting and storing writing instruments, and more particularly to a portable container for holding, transporting and storing writing instruments in the shape of a vehicle which facilitates transportation of the writing instruments and improves upon the usefulness of the container.

BACKGROUND OF THE INVENTION

There are many different types of containers for holding, transporting and storing writing instruments. Traditionally, the containers are capable of holding many different types of writing instruments, such as pens, pencils, markers, crayons and the like. While transporting the writing instruments, the containers typically have closeable covers to secure the writing instruments within the container. In addition, some containers have handles to facilitate the transport, while others are designed to be carried by grasping the container in the palm of the hand.

The above containers, while workable, have certain drawbacks and deficiencies. Specifically, the containers are typically designed to provide the functional purpose of holding, storing or transporting writing instruments. As a result, the usefulness of the containers are usually severely restricted by the functional limitations of their designs. Similarly, the aesthetic appeal of the design of the container also suffers. Accordingly, the enjoyment derived by the user of the containers and the ultimate marketability of containers is reduced.

In addition, while carrying the container by grasping it or by grasping its handle may be a practical way of transporting the writing instruments, the enjoyment derived from such an endeavor is again quite limited. As a result of the above limitations, the containers are typically used as passive functional devices for holding, storing and transporting the writing instruments.

SUMMARY OF THE INVENTION

Accordingly, a general object of the present invention is to provide writing instrument container having a construction capable of holding, storing and transporting a plurality of writing instruments.

Another general object of the present invention is to provide a container in the shape of a vehicle having functioning wheels to improve upon the playfulness of and enjoyment derived from the container and to facilitate transportation of the writing instruments.

A further object of the invention is to provide a container which holds the writing instruments securely in the container.

An additional object of the invention is to provide a container which holds the writing instruments in a substantially vertical position.

Another object of the invention is to provide a kit which includes a writing instrument container in the shape of a vehicle and writing instruments.

The foregoing and other objects, in the present invention, are embodied in an improved container for holding, storing and transporting writing instruments. This container is different from prior containers in that the design of the container is in the shape of a vehicle, such as a school bus, an automobile, a train, a truck, a trailer or the like. The container is capable of holding a plurality of writing instruments within said container. Consistent with the vehicle design, the container has operative wheels to aid in the transportation of the container and the writing instruments in the container.

An advantage to the present invention includes the ability to play with the container by pushing the container along a surface, thereby making the transporting of the container easier under some circumstances and more enjoyable, particularly for the younger users. For the older users, the novel design and additional functionality of the construction add to the marketability of the container. Of course, the container can also be transported by grasping the entirety of the container and moving the container.

While the invention will be described in connection with certain preferred embodiments, it is not intended that the invention be limited to those specific embodiments but rather that it be accorded a broad scope commensurate with the appended claims.

BRIEF DESCRIPTION OF THE DRAWINGS

FIG. 1 is top left front perspective view of a writing instrument container in the form of a school bus.

FIG. 3 is a left side elevational view of the present invention shown in FIG. 1.

FIG. 4 is the right side elevational view of the present invention shown in FIG. 1.

FIG. 5 is the front elevational view of the present invention shown in FIG. 1.

FIG. 6 is the rear elevational view of the present invention shown in FIG. 1.

FIG. 7 is the top plan view of the present invention shown in FIG. 1.

DETAILED DESCRIPTION OF THE PREFERRED EMBODIMENTS

Figure 2:
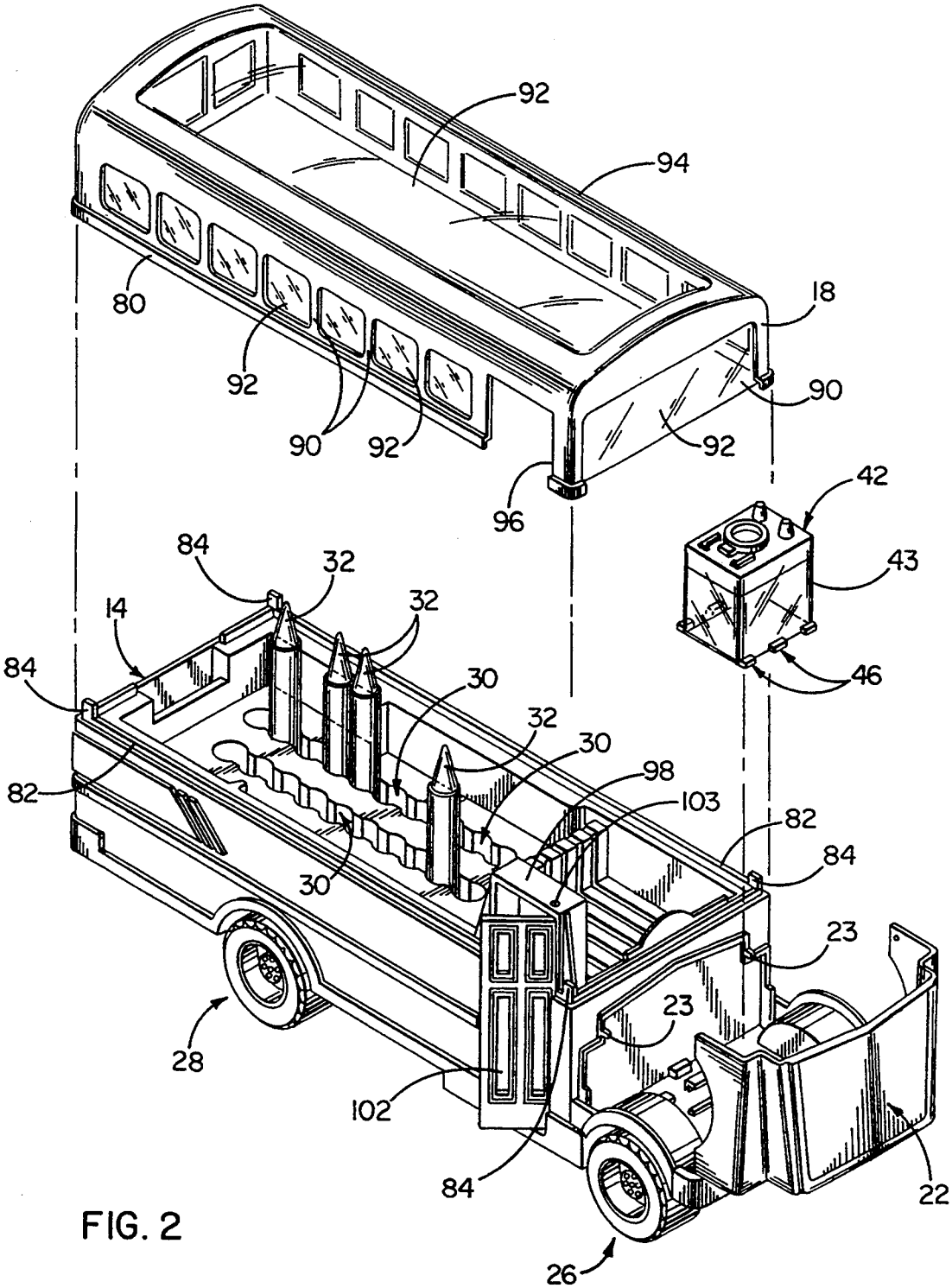
FIG. 2 is an exploded top left front perspective view of the present invention shown FIG. 1 showing the arrangement of some of its major elements.

Referring to FIG. 1, there is shown a perspective view of a preferred embodiment of the writing instrument container 10 in the form of a school bus. The container 10 consists generally of a housing 14, a roof 18, a hood member 22, a set of front wheels 26 and a set of rear wheels 28.

As shown in FIG. 2, the roof 18 of the container 10 is removable to allow access to a plurality of compartments 30 for holding a plurality of writing instruments 32. While the compartments 30 shown in FIG. 2 are designed to hold crayons, it should be appreciated that the design of the compartments 30 can be readily modified to accommodate additional types of writing instruments, such as pens, pencils, markers and the like. Furthermore, the compartments can be modified to hold scissors, stencils, erasers, rulers, sharpeners and other items.

Figure 9:
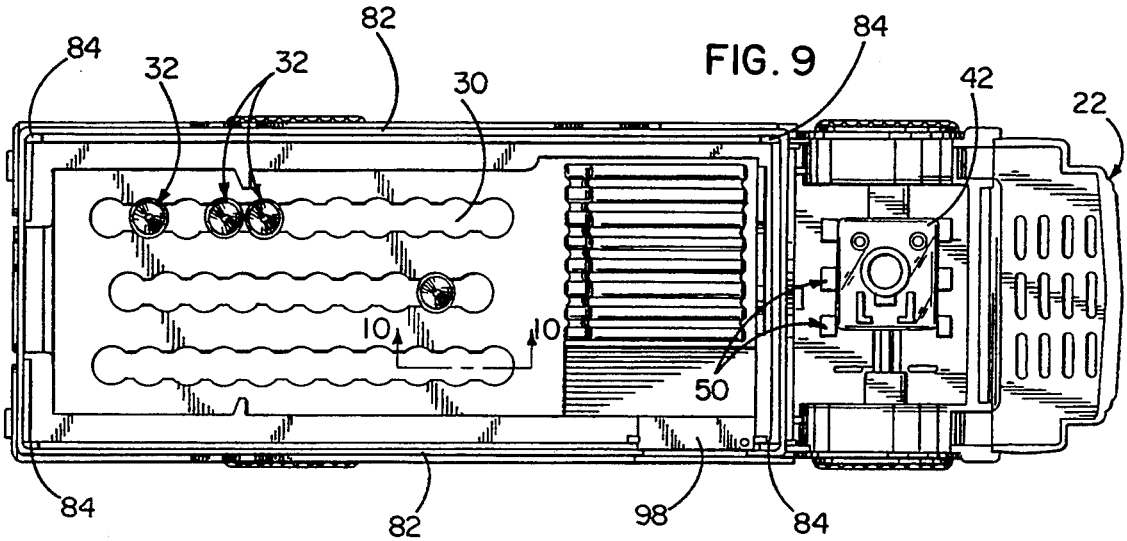
FIG. 9 is a top plan view of the present invention shown in FIG. 1 with the roof removed and the hood in the open position.
Figure 10:
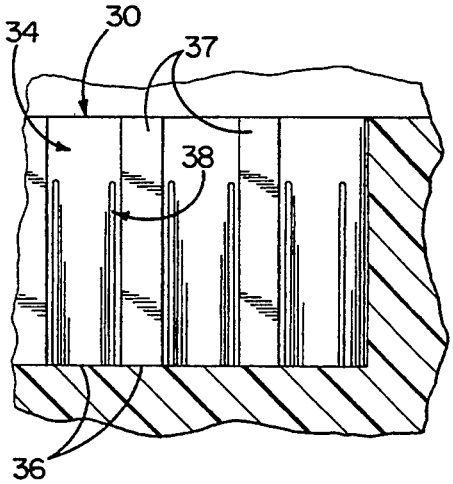
FIG. 10 is an enlarged partial cross-sectional view taken along line 10—10 in FIG. 9 of a plurality of compartments used to hold the writing instruments.
Figure 11:
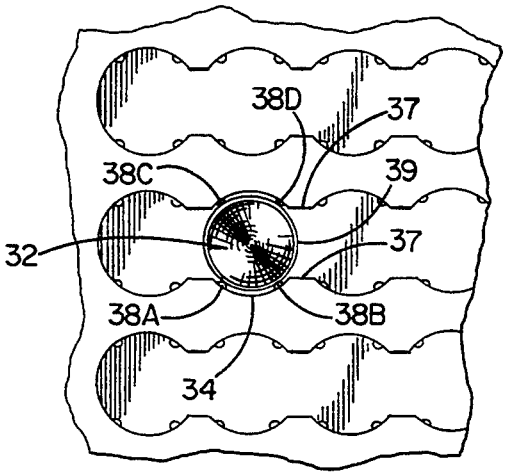
FIG. 11 is an enlarged partial view of the compartment area shown in FIG. 9 showing the compartments and a writing instrument.

FIG. 10 shows a partial cross-sectional view of the plurality of compartments 30 along line 10—10 in FIG. 9 and FIG. 11 shows an enlarged partial view of the compartment area shown in FIG. 9. Referring to FIGS. 10 and 11, each compartment 30 is comprised of a curved outer wall 34 and ridges 38. In the preferred embodiment, the writing instrument 32 is inserted into the compartment 30 and is frictionally secured within the compartment 30 by the wall 34 and the ridges 38. The ridges 38 extend from the base 36 of the compartment 30 to approximately 50 or 60 percent of the height of the compartment 30. The ridges 38A and 38B are separated from each other approximately 5/32 of an inch and the ridges 38A and 38C are separated from each other approximately ¼ of an inch. The ridges 38A and 38D are separated from each other by approximately 5/16 of an inch each. The curved wall 34 is connected by a straight wall 37.

The user inserts the writing instrument 32 into the compartment 30 by pushing downwards on the instrument 32. The exterior surface 39 of the instrument engages the ridges 38. The spacing of the ridges 38 is slightly less than the exterior surface 39 of the instrument 32. Thus, each instrument 32 is frictionally held in the compartment 30. In order to remove the instrument 32, the user simply pulls upward on the instrument 32 to remove the instrument 32 from the compartment 30.

Furthermore, the compartments can have many different shapes and configurations. As shown in FIG. 9, the compartments 30 comprise three rows. The two outside rows can accommodate eleven writing instruments and the center row can accommodate ten writing instruments. In another configuration shown in FIG. 12, the compartments 30 comprise four rows. Each of the rows can accommodate twelve writing instruments. In addition, each compartment can be an individual opening in the housing for each writing instrument.

In addition, the compartments may not contain the ridges 38 and the writing instruments may not frictionally engage the compartments. For example, the writing instruments may be loosely held in a substantially vertical position by the compartments. Consequently, in order to remove the instruments 32, the user would not need to exert any additional upward force to disengage the instrument 32 from the compartment 30. As a further example, if the user were to turn the container 10 upside down, then the instrument 32 would fall downwards away from the compartment 30.

Referring back to FIGS. 1, 2 and 9, the hood member 22 pivots about an axis at the front end of the housing 14 to allow access to a writing instrument sharpener 42. Tabs 23 are positioned on the front side of the housing to engage the interior of the hood 22. The sharpener 42 has a removable bottom 43 so that the user can empty the shavings created by the sharpener. The sharpener 42 is attached to and removable from the front end of the housing 14. The flanges 46 of the writing instrument sharpener 42 are positioned underneath the protruding channels 50 of the housing 14 as shown in FIG. 9.

Figure 8:
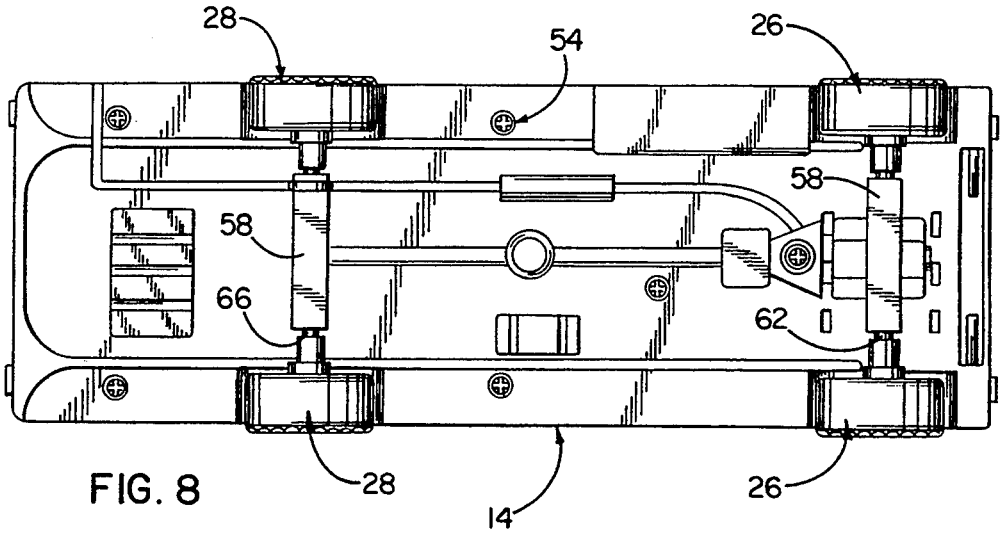
FIG. 8 is the bottom plan view of the present invention shown in FIG. 1.

As shown in FIG. 8, the front wheels 26 and the rear wheels 28 are attached to a front axle 62 and a rear axle 66, respectively. The front and rear axles 62 and 66 are attached to a bottom portion 54 of the housing 14 with axle flanges 58. The flanges 58 have apertures for the axles or wheel hubs. Thus, the front wheels 26 and the rear wheels 28 can rotate so that the instrument 10 can be rolled along a surface.

Typically, the invention operates and is used as follows. To store the writing instruments, the writing instruments are placed in the plurality of compartments 30 with the roof 18 of the writing instrument container 10 secured to the top of the housing 14. In addition, the sharpener 42 is attached to the housing 14 and the hood member 22 is pivoted in a closed position as shown in FIG. 1. To transport the writing instrument container 10 containing the stored writing instruments 32, the container 10 can be carried or pushed along a surface, such as a floor or a table. The latter method of transportation can be particularly advantageous in certain situations. For example, if two or more persons are sharing the writing instruments, it is a simple procedure to push the writing instrument container 10 across a table so that the next person can use the writing instruments.

Referring to FIG. 2, the roof 18 is removable to allow access to the writing instruments 32. The roof 18 has a lip 80 which extends downward around the perimeter of the roof. The lip 80 engages the upper edge 82 of the housing 14. In addition, posts 84 are located at the corners of the upper edge 82 to engage the roof 18. The lip 80 in conjunction with the upper edge 82 and the posts 84 prevent the roof from moving horizontally relative to the housing 14. Consequently, the user must raise the roof 18 in a vertical direction in order to remove the roof 18 from the housing 14.

The roof 18 has openings 90 which resemble window openings. The openings 90 are covered with clear plastic 92 to resemble windows. In addition, the roof 18 contains an opening 94 which allows the user to view inside the container 10 and determine the contents of the container. The opening 94 is also covered with clear plastic 92. The clear plastic 92 is formed as one component for all of the openings and is attached to the interior of the roof 18. The roof also has a notch 96 to accommodate the door frame 98.

The housing 14 includes a door frame 98 and an operable door 102. The door 102 can pivot outwards by rotating about a vertical axis 103 near the front portion of the door frame 98.

Figure 12:
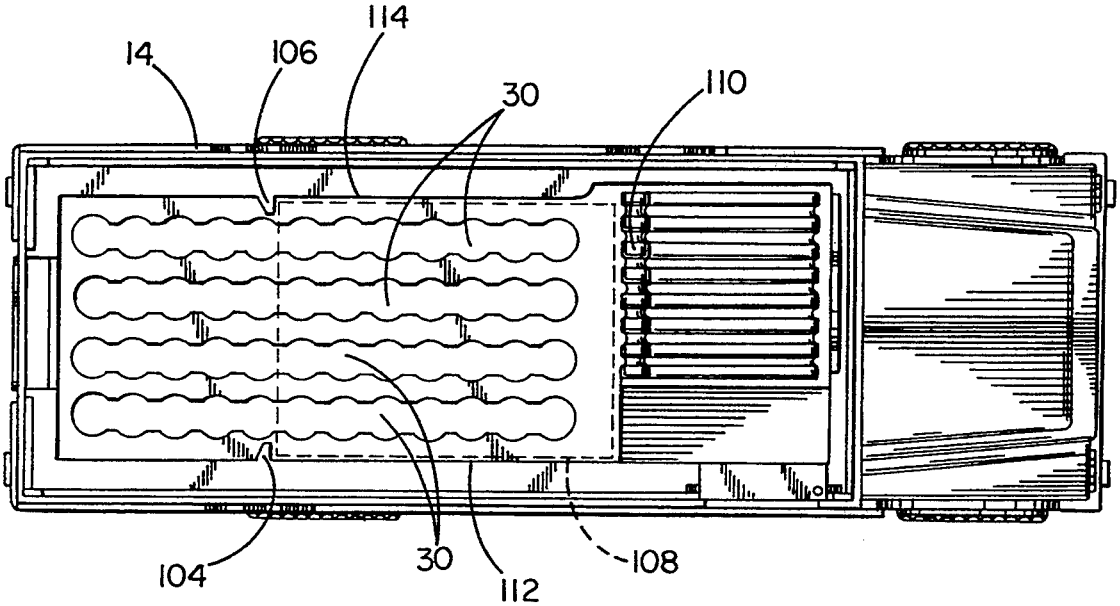
FIG. 12 is an alternative embodiment with the roof removed and showing an alternative configuration of the compartments for the writing instruments.

Referring to FIG. 12, the interior of the housing 14 includes protrusions 104 and 106. A box 108 of writing instruments is shown in phantom lines. The box 108 can be positioned horizontally in the housing for shipping to the position by the protrusions 104 and 106, by the rear edge of the seat 100, and by the interior side walls 112 and 114 of the housing 14.

Figure 13:
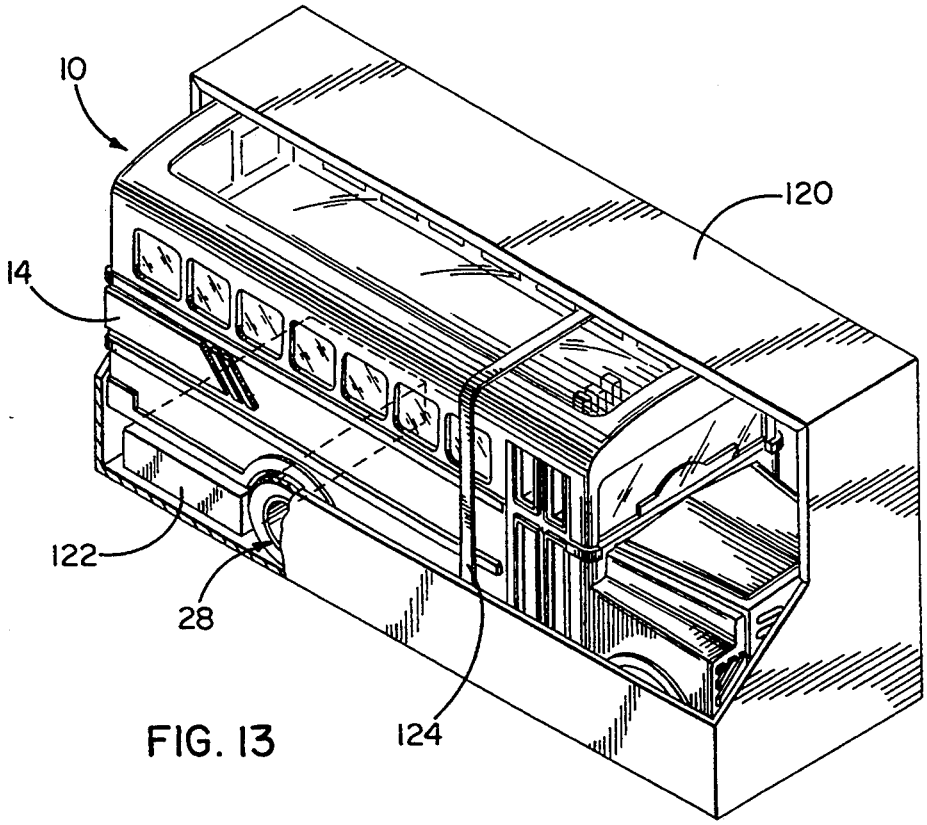
FIG. 13 is a top left front perspective view of the writing instrument container, a box of writing instruments and enclosure for the writing instrument container and writing instruments.

As shown in FIG. 13, the writing container 10 and the writing instruments 32 can be packaged into an enclosure or container 120 to create a kit. In this particular embodiment, the enclosure 120 is a cardboard box. However, the enclosure could be other materials such as shrink wrap material, a cardboard box with an opening to view the product, a cardboard box with an opening and a transparatent window in the opening to view the product or a blister card enclosure. Furthermore, in this particular embodiment, the writing instruments are packaged into a box 122. The box 122 is placed under the housing 14 and behind the rear wheels 28. When located in this position, the box 122 is held in a horizontally and 15 vertically fixed position for shipment to the customer. However, the writing instruments 32 could be positioned into the compartments 30 or in other locations in the writing instrument container 10 or enclosure 120. For example, the writing instruments could be placed in the box 108 as shown in FIG. 12. Consequently, the customer receives a kit including a writing instrument container 10 and writing instruments 32 which are packaged in an enclosure 120.

Furthermore, the writing instrument container 10 can be packaged without the enclosure 120. The writing instruments are placed in a box 108 as shown in FIG. 12, in the compartments 30 or in other locations in the container 10. A securing device 124 secures the roof 18 or upper portion of the container to the housing 14 or lower portion of the container. The securing device 124 can be a rubber band, a plastic band or adhesive tape. By using the securing device 124, the kit does not require an enclosure or container 120. Thus, the customer receives a kit including a writing instrument container 10 and writing instruments 32 which are enclosed in the container 10.

Figure 14:
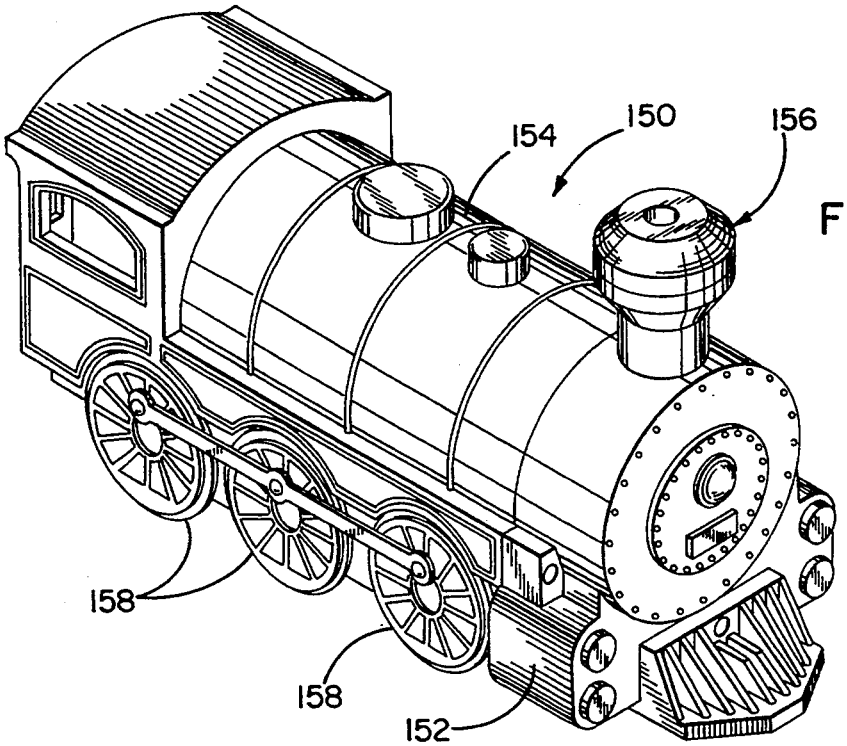
FIG. 14 is a top left front perspective view of a writing instrument container in the form of a locomotive.
Figure 15:
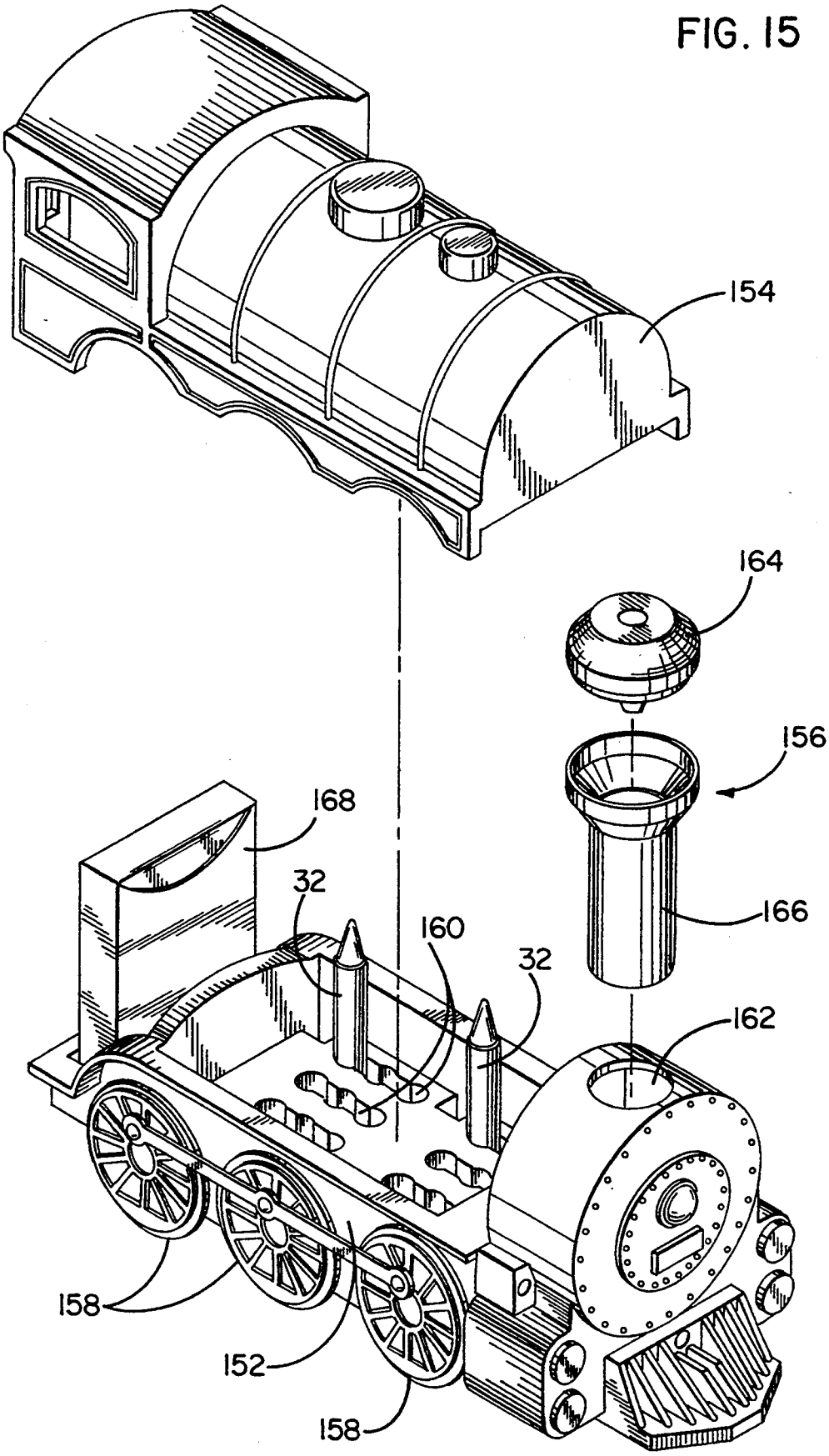
FIG. 15 is an exploded top left front perspective view of the invention shown in FIG. 14.

Alternate embodiments of the present invention include writing instrument containers in the form of other vehicles, such as automobiles, trucks, trailers, airplanes and trains. For example, FIGS. 14 and 15 show a writing instrument container in the shape of a train engine or steam locomotive 150. Referring to FIG. 15, the locomotive 150 includes a lower housing 152, an upper housing 154, a removable sharpener 156 in the shape of a smoke stack, wheels 158 and compartments 160.

The upper housing 154 is removable from the lower housing 152 to gain access to the interior of the lower housing 152. The lower housing 152 includes compartments 160 for the storage of writing instruments 32. In this particular embodiment, the compartments 30 comprise eight rows. Each row can accommodate three writing instruments 32.

The sharpener 156 is removable from the lower housing 152 and fits into aperture 162. The sharpener 156 includes the sharpener portion 164 and the shavings container 166. The sharpener portion 164 is removable so that the user can empty the shavings from the container 166.

The rear portion of the housing 152 can accommodate a box 168 of writing instruments. The box 168 can be positioned vertically in the housing for shipment to the customer. The box 168 is held in a horizontally and vertically fixed position by the lower housing 152 and the upper housing 154.

While particular embodiments of the invention have been shown, it will be understood, of course, that the invention is not limited to those embodiments. On the contrary, it is intended to cover all alternatives, modifications and equivalents, as may be included within the spirit and scope of the invention as defined by the appended claims.

What is claimed is:

1. A portable writing instrument container comprising:

at least one writing instrument; and a housing in the shape of a vehicle having a lower portion and an upper portion, the upper portion is removable from the lower portion, the lower portion includes a holding portion to hold a plurality of writing instruments in a relatively vertical position wherein the upper portion meets the lower portion at an edge and a portion of said writing instruments extend above a portion of said edge wherein said upper portion has an area which allows the writing instrument to be visible through said area.

2. The invention of claim 1 wherein said holding portion has a plurality of compartments.

3. The invention of claim 2 wherein said compartments are individual openings for the writing instruments.

4. The invention of claim 2 wherein said compartments include curved wall portions and straight wall portions.

5. The invention of claim 1 wherein said housing is operatively connected to wheels.

6. The invention of claim 1 wherein said holding portion holds a plurality of crayons.

7. The invention of claim 1 wherein said holding portion secures a plurality of writing instruments to said holding portion.

8. The invention of claim 7 wherein said holding portion frictionally engages a writing instrument.

9. The invention of claim 8 wherein said holding portion includes a ridge for engaging a writing instrument.

10. The invention of claim 9 wherein said holding portion includes four ridges.

11. The invention of claim 1 wherein said housing has a portion capable of holding a writing instrument sharpener to said housing.

12. The invention of claim 1 further comprising a writing instrument sharpener.

13. The invention of claim 1 wherein said holding portion engages the outer surface of said writing instrument.

14. The invention of claim 1 wherein said holding portion engages the lower portion of said writing instrument.

15. The invention of claim 1 wherein said housing includes an operable door.

16. The invention of claim 1 wherein said housing portion is in the shape of a bus.

17. The invention of claim 1 wherein said housing is in the shape of a locomotive.

18. The invention of claim 1 wherein said upper removable portion is a roof.

19. The invention of claim 1 wherein said area is an opening in said upper portion.

20. The invention of claim 1 wherein said area is transparent.

21. The invention of claim 1 further comprising a first enclosure for said writing instrument container.

22. The invention of claim 21 wherein said first enclosure is a box.

23. The invention of claim 21 further comprising a second enclosure for said writing instrument.

24. The invention of claim 23 wherein said first enclosure is a box and said second enclosure is a box.

25. The invention of claim 1 further comprising a first enclosure for said writing instrument.

26. The invention of claim 25 wherein said first enclosure is a box.

27. A writing instrument container kit, comprising:

a writing instrument container in the shape of a vehicle having a lower portion and an upper portion, the upper portion is removable from the lower portion, the lower portion includes a plurality of compartments for writing instruments;

a first enclosure containing said writing instrument container and a second enclosure; and at least one writing instrument in said second enclosure.

28. The invention of claim 27 wherein said second enclosure is a box.

29. The invention of claim 28 wherein said first enclosure is a box.

30. The invention of claim 27 wherein said first enclosure is a box.

31. The invention of claim 27 wherein said upper portion meets the lower portion at an edge and a portion of said writing instrument extends above a portion of said edge.

32. The invention of claim 31 wherein said writing instrument is held in a substantially vertical position.

33. The invention of claim 27 wherein said container is operatively connected to wheels.

34. The invention of claim 27 wherein said container has a portion capable of holding a writing instrument sharpener to said container.

35. The invention of claim 27 further comprising a writing instrument sharpener.

36. The invention of claim 35 wherein said sharpener is located under a hinged component.

37. The invention of claim 35 wherein said portion is an opening in said container.

38. The invention of claim 27 wherein said compartments secure said writing instruments.

39. The invention of claim 38 wherein said compartments frictionally engage said writing instruments.

40. The invention of claim 39 wherein said compartment includes a ridge for engaging a writing instrument.

41. The invention of claim 27 wherein said compartments include curved wall portions and straight wall portions.

42. The invention of claim 27 wherein said container includes a hinged component.

43. The invention of claim 42 wherein said hinged component is a door.

44. The invention of claim 42 wherein said hinged component is a hood.

45. The invention of claim 27 wherein said vehicle is a bus.

46. The invention of claim 27 wherein said vehicle is a locomotive.

47. The invention of claim 27 wherein said upper removable portion is a roof.

48. The invention of claim 27 wherein said upper portion and said lower portion are secured together by a securing device to prevent separation of said upper portion from said lower portion.

49. The invention of claim 48 wherein said securing device is a plastic band.

50. A portable writing instrument container comprising:

a housing in the shape of a vehicle, said housing includes a plurality of compartments for said writing instruments, said housing includes a sharpener for said writing instruments which is part of the vehicle design and said sharpener is removably positioned on said housing by flanges and channels wherein said sharpener includes a shavings container.

51. The invention of claim 50 wherein said housing is operatively connected to wheels.

52. The invention of claim 50 wherein said compartments frictionally engage writing instruments.

53. The invention of claim 52 wherein said compartment includes a ridge for engaging a writing instrument.

54. The invention of claim 50 wherein said housing includes a hinged component.

55. The invention of claim 54 wherein said sharpener is located under said hinged component.

56. The invention of claim 50 herein said vehicle is a bus.

57. The invention of claim 50 wherein said vehicle is a locomotive.

58. A portable writing instrument container comprising:

a housing in the shape of a locomotive, said housing includes a plurality of compartments for writing instruments, said housing includes a sharpener for writing instruments wherein said sharpener is removably positioned on said housing, said sharpener includes a shavings container and said sharpener is the shape of a smokestack.

59. The invention of claim 58 wherein said housing is operatively connected to wheels.

60. The invention of claim 58 wherein said compartments frictionally engage writing instruments.

61. The invention of claim 60 wherein said compartment includes a ridge for engaging a writing instrument.

62. The invention of claim 58 wherein said compartments include curved wall portions and straight wall portions.

63. The invention of claim 58 wherein a writing instrument is held in a substantially vertical position.

64. A portable writing instrument container comprising:

a housing in the shape of a vehicle, said housing includes a plurality of compartments for writing instruments, said housing includes a sharpener for writing instruments removably positioned on said housing wherein said sharpener is the shape of a vehicle engine.

65. The invention of claim 64 wherein said housing is operatively connected to wheels.

66. The invention of claim 64 wherein said compartments frictionally engage writing instruments.

67. The invention of claim 66 wherein said compartment includes a ridge for engaging a writing instrument.

68. The invention of claim 64 wherein said housing includes a hinged component.

69. The invention of claim 68 wherein said sharpener is located under a hinged component.

70. The invention of claim 64 wherein said vehicle is a bus.

71. The invention of claim 64 wherein said compartments include curved wall portions and straight wall portions.

72. The invention of claim 64 wherein a writing instrument is held in a substantially vertical position.

73. The invention of claim 64 wherein said sharpener includes a shavings container.

74. A portable writing instrument container comprising:

a housing in the shape of a vehicle, said housing includes a plurality of compartments for writing instruments, said housing includes a sharpener for writing instruments removably positioned on said housing wherein said sharpener has an opening for the instrument in the top of the sharpener.

75. The invention of claim 74 wherein said housing is operatively connected to wheels.

76. The invention of claim 74 wherein said compartments frictionally engage writing instruments.

77. The invention of claim 76 wherein said compartment includes a ridge for engaging a writing instrument.

78. The invention of claim 74 wherein said housing includes a hinged component.

79. The invention of claim 78 wherein said sharpener is located under said hinged component.

80. The invention of claim 74 wherein said vehicle is a bus.

81. The invention of claim 74 wherein said vehicle is a locomotive.

82. The invention of claim 74 wherein said compartments include curved wall portions and straight wall portions.

83. The invention of claim 74 wherein a writing instrument is held in a substantially vertical position.

84. The invention of claim 74 wherein said sharpener includes a shavings container.

* * * * *

UNITED STATES PATENT AND TRADEMARK OFFICE

CERTIFICATE OF CORRECTION

PATENT NO. : 5,441,149

DATED : August 15, 1995

INVENTOR(S) : Michael D. Willard et al.

It is certified that error appears in the above-indentified patent and that said Letters Patent is hereby corrected as shown below:

Col. 4, line 56, before "position by the protrusions" insert --customer. The box 108 is held in a horizontally fixed--.

Col. 5, line 4, delete "15".

Signed and Sealed this

Thirty-first Day of October 1995

*Attest:*

BRUCE LEHMAN

*Attesting Officer*

*Commissioner of Patents and Trademarks*